United States Patent [19]

Kempa

[11] 4,210,300

[45] Jul. 1, 1980

[54] POINT SWITCH

[75] Inventor: Bernd-Joachim Kempa, Berlin, Fed. Rep. of Germany

[73] Assignee: Elektro-Thermit GmbH., Fed. Rep. of Germany

[21] Appl. No.: 30,750

[22] Filed: Apr. 17, 1979

[30] Foreign Application Priority Data

Apr. 22, 1978 [DE] Fed. Rep. of Germany ..... 2817782

[51] Int. Cl.[2] ..... E01B 7/08

[52] U.S. Cl. ..... 246/430; 246/380; 246/392

[58] Field of Search ..... 246/430, 392, 380, 401, 246/402, 415 R, 435 R, 442, 443, 448, 453, 273, 391, 385–390

[56] References Cited

U.S. PATENT DOCUMENTS 3,977,635 8/1976 Pirker et al. ..... 246/387

FOREIGN PATENT DOCUMENTS 2705122 8/1977 Fed. Rep. of Germany ..... 246/430

*Primary Examiner*—Charles E. Frankfort
*Assistant Examiner*—Reinhard J, Eisenzopf
*Attorney, Agent, or Firm*—James E. Bryan

[57] ABSTRACT

This invention relates to an improvement in a point switch in which the switch blades or tongues are composed of rail sections of the trunk or main track and are displaceably positioned on slide chairs in the transverse rail direction, the improvement comprising a shaft on which each slide chair is slidingly mounted between two bearing blocks, one of the bearing blocks being inside the track and the other of the bearing blocks being outside of the track, welds rigidly connecting the bearing blocks with a joint base plate, and two rods on each chair parallel to the shaft, a first one of the rods being adapted to contact a stop in a recess in the outside bearing block, and a second one of the rods being adapted to contact a lock in a recess in the outside bearing block, whereby in an unlocked condition the first one of the rods contacts the stop, and in a locked condition the second one of the rods contacts the lock.

8 Claims, 8 Drawing Figures

POINT SWITCH

Figure 1:
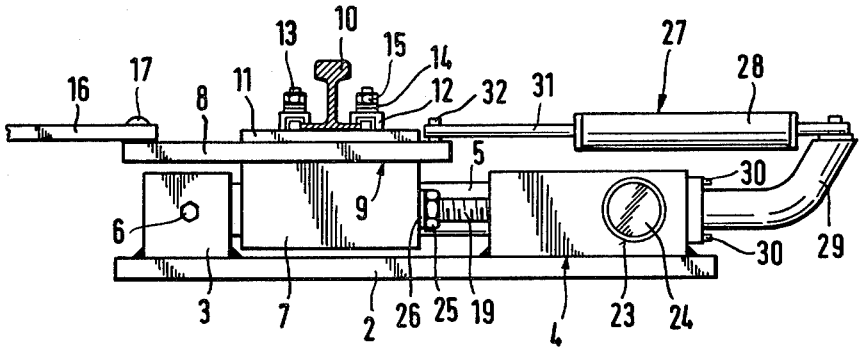

The present invention relates to a point switch in which the switch blades or tongues are composed of rail sections of the trunk or main track and are displaceably positioned on slide chairs in the transverse rail direction.

The slide chairs which represent in general flat, planar plates render it possible to laterally displace the point switch. These slide chairs generally form base plates on which the heavy point switches are moved during displacement of the switch. Attempts now have been made to improve the frictional properties of the parts sliding upon each other.

It is known, for example, from German Offenlegungsschrift No. 2,705,122 to reduce the friction between the profile rail foot and the slide chair by means of intermediate layers of sliding plastic parts. The useful life of these sliding plastic parts being provided in such a manner is, however, relatively short because they are directly subjected to weathering and particularly to ultraviolet solar radiation. These influences have a decomposing effect on the sliding plastic parts.

Further known in the art are slide chairs in which the profiled rail is secured to a movably positioned plate or to an especially made forged piece, and the plate or the forged piece is slidingly positioned on yet another plate securely positioned on the ground. The metallic sliding plates or slide chairs according to the state of the art require regular maintenance and lubrication; on the one hand in order to facilitate the displacement of the point switches and, on the other hand, in order to protect the sliding plates, which are generally made from steel, against corrosion.

Furthermore, the prior art slide chairs have the disadvantage that in their case the deflections arising during or under load, i.e. when the sectional rail is traveled on, are further passed on as torsional moments to the base of the slide chair. These very strong torsional moments have the effect that the ties will execute rotary movements within the bed of crushed rock, whereby the ties undergo considerable wear and tear at the lower outer edges thereof and loosen the crushed rock bedding, all of which may lead to displacements within the crushed rock. In the case of a superstructure or top of roadbed without crushed rock and composed of concrete plates or concrete slabs, these effects become manifest by the formation of cracks in the concrete foundation.

Another disadvantage also has been observed in connection with the known mechanisms for the displacement of the rails resting on the slide chairs, and it is that the locking in the respective traveling position has been solved only insufficiently. Thus it has been proposed to effect the locking or clamping of the slide chairs movable on the plates by means of the insertion of locking elements. This measure has, however, the disadvantage that a certain clearance must exist for the insertion of these locking elements between the slide chair and the base plate. This clearance, however, increases after a short period of time due to the forces arising during the running-over of the wheels.

It also has been attempted to solve the problem of the locking by means of wedge-shaped elements, yet this in turn involves the danger of the wedging of these locking elements.

It is therefore the object of the present invention to provide a slide chair which is reliable as to its maintenance and not very susceptible to malfunctions, which slide chair is adapted to divert or shunt the forces arising during the running-over thereof by the wheels without causing damage to the foundation and moreover to render possible a safe locking of the transversely movable rail sections which are mounted on these slide chairs.

According to the present invention, this object is obtained by virtue of the fact that the slide chair is slidingly positioned on a shaft, the latter being positioned between two bearing blocks, namely one bearing block which is arranged within the track, and one bearing block arranged outside of the track, which bearing blocks are rigidly connected with a joint base plate, and includes two threaded rods positioned on both sides parallel to the shaft, which rods are in operative engagement with a stop positioned in recesses of the bearing blocks, and with a locking element whereby, in the locked position, the threaded rod is pressed against the locking element and, in the unlocked position, the threaded rod rests against a stop.

It has been found that, by virtue of such an arrangement of the slide chair, the rail deflections arising during the running-over thereof by the wheels will no longer be diverted or shunted as torsional moments on to the foundation, i.e. on to the crushed rock or the concrete, because they are compensated by the shaft secured between the two bearing blocks. It is easy to accomplish the lubrication of the shaft. Any lubricant which may possibly have gone astray during the lubrication process cannot get onto the crushed rock because it will remain on the joint base plate and can be removed therefrom. The locking element positioned in the recesses of the bearing block, or the stop arranged in a further recess will assure that the transversely movable rail section is irreversibly positioned in its original or in a deviating position. Thereby the threaded rods which extend on both sides parallel to the shaft are in operative engagement with the stop and with the locking element, and thus retain the track in its respective position. When the end of one threaded rod on one side of the track presses against the stop which is formed, for example, from friction springs, the end of the threaded rod on the opposite side is held in place by the locking mechanism. The track is locked in place. The threaded rod extending parallel on the other side of the shaft is in the unlocked position on one as well as on the other side of the track, i.e. they are not held by the stop and the locking element.

It is of particular advantage that the slide chair is composed of a block which is force-lockingly connected with a plate, whereby the block has a bore centrally disposed and transversely with respect to the longitudinal rail direction for the passage of the shaft, and further has on both sides and parallel thereto bores provided with threads for the attachment of the threaded rods. It is to this plate connected with the block that the rail is then attached in the conventional manner. The block slides horizontally over the shaft secured between the bearing blocks. The track is thereby displaceable in a simple manner in the transverse direction. It is desirable that the threaded rods on both sides and parallel to the shaft are adjustable in the block and lockable in the adjusted position thereof. By virtue of this adjustability of the threaded rods it is possible, even after the completion of the switch system, to make changes relative to the geometry in the deflecting area.

It is further of particular advantage that the two oppositely positioned slide chairs are connected with each other by means of a hingedly connected cross tie. This cross tie maintains at all times that two rails which are to be displaced at a parallel distance with respect to each other. It also assures the joint transverse movement of the two rails. This transverse movement is effected by pneumatically- or hydraulically-operated shifting cylinders. These shifting cylinders engage in a known manner at the slide chair by way of a piston rod and pull the slide chair, together with the rail which is secured thereto, in the respectively desired direction.

In a preferred embodiment of the present invention all of the locking elements disposed on one side are lockable or unlockable by means of a joint linkage system, the latter being guided within recesses of the bearing blocks, with the recesses being arranged in the longitudinal rail direction.

With the aid of this linkage system disposed in the longitudinal rail direction it is possible to effect at the same time the unlocking or locking of the slide chairs disposed in the switch section. Thereby it is of particular advantage that the linkage system is a piston rod system by means of which the locking elements disposed in the bearing blocks are displaceable in the longitudinal rail direction. The slides secured to the linkage system are slid into the unlocking or locking position thereof, whereby on the unlocked side of the track the threaded rods have free passage, whereas on the locking side they are arrested by means of the slide which blocks the passage thereof and in that the end of the threaded rod presses against the slide.

According to another advantageous embodiment of the present invention it is proposed that the linkage system is axially rotatable and the locking elements which are rigidly connected with the linkage system and have cylindrical shape have, in the unlocked position thereof, a bore into which the threaded rod is insertable. In this arrangement, the simultaneous unlocking or locking is effected in that the linkage system is so rotated that, in the unlocked condition, the threaded rods may slide through a recess within the locking element and, in the locked condition thereof, the recess is axially displaced about 90° so that the threaded rod finds support at the thus locked locking element.

In that case, the longitudinal or the rotary movement of the linkage system desirably takes place by means of pneumatic or hydraulic shifting cylinders. WIth the aid of these pneumatic or hydraulic cylinders, the unlocking or locking is thus carried out simultaneously.

With the present invention, a perfect and maintenance-free displacement of the transversely movable rail sections is obtained, whereby the respective position of the track is immovably secured due to the simultaneous locking action.

Figure 2:
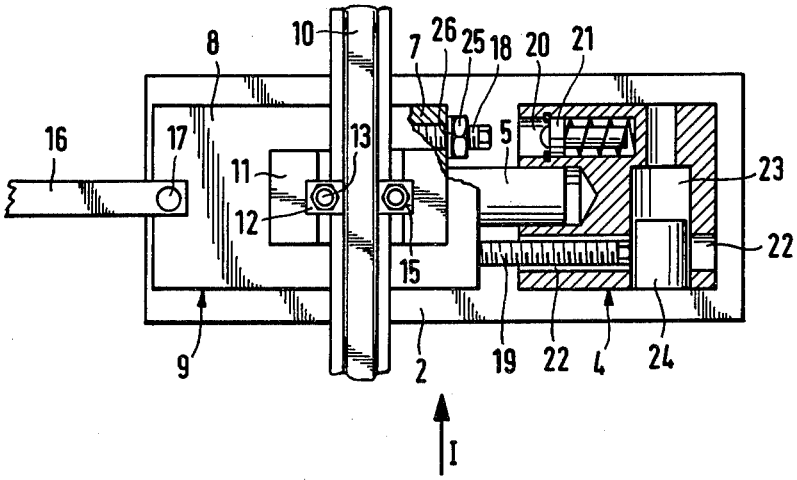
Figure 3:
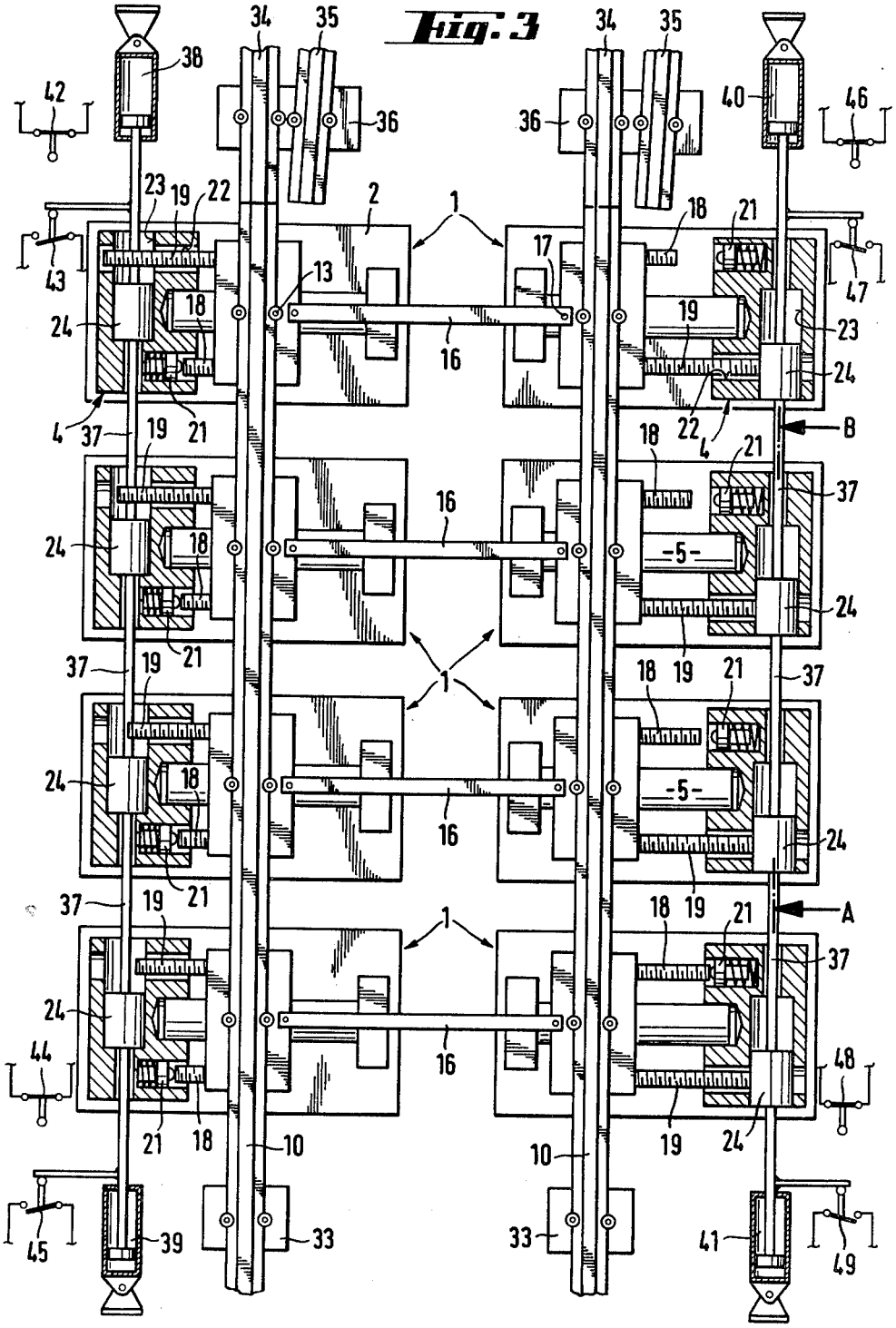
Figure 4:
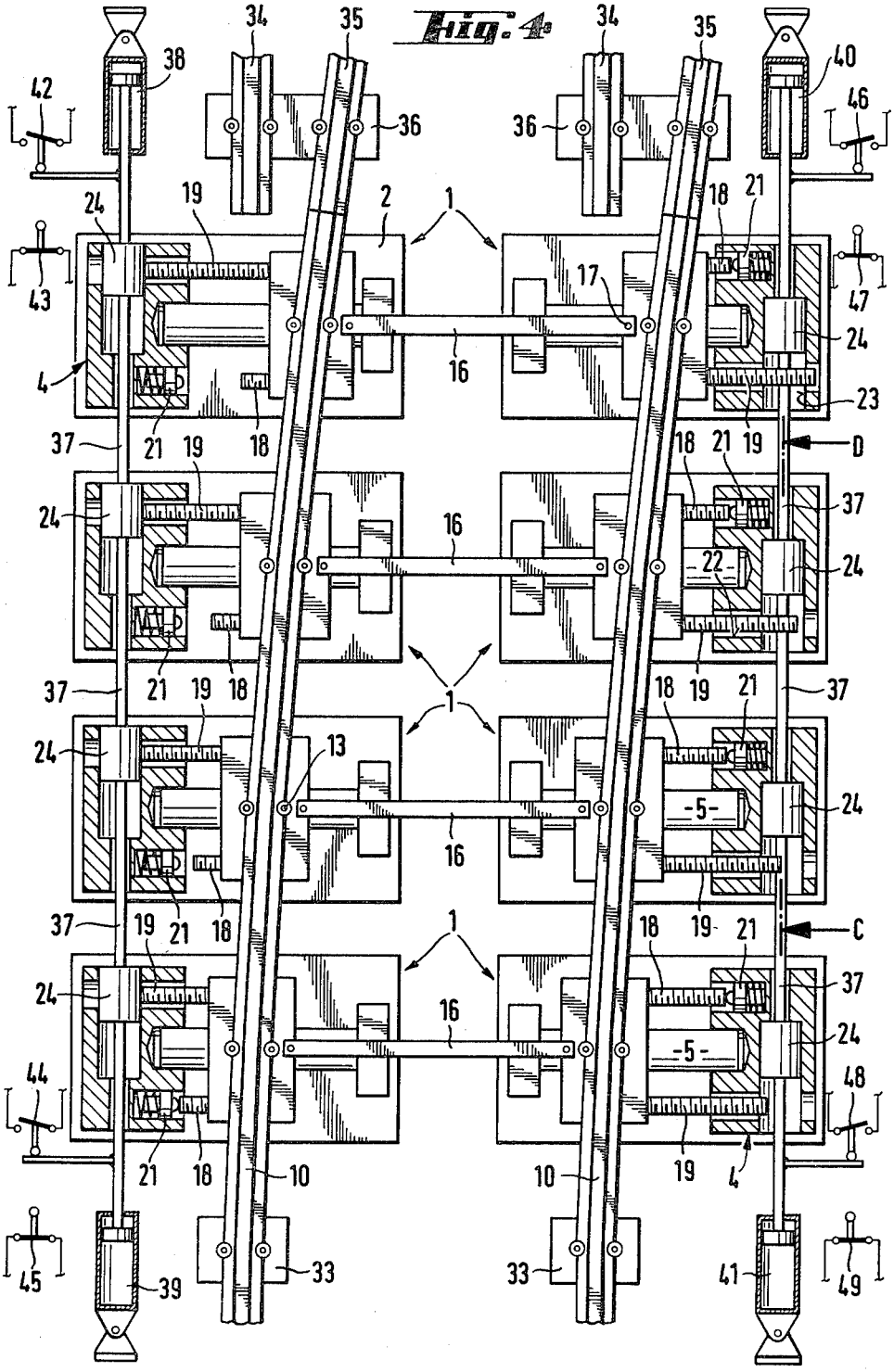
Figure 5:
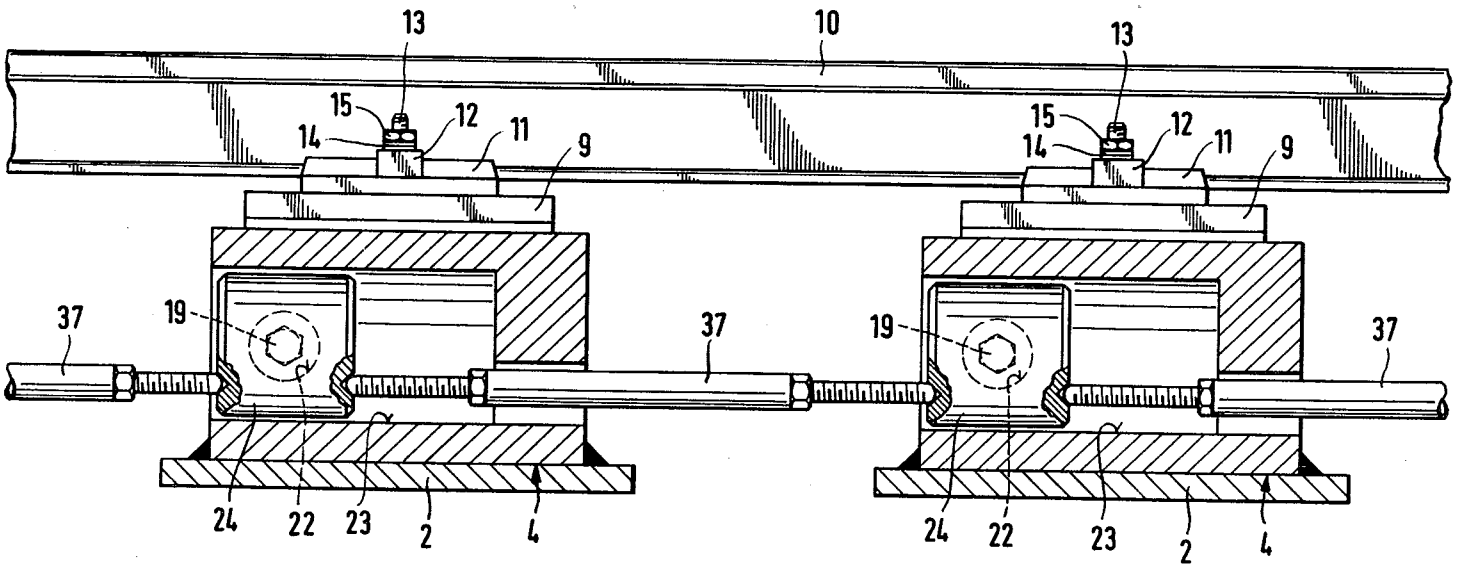
Figure 6:
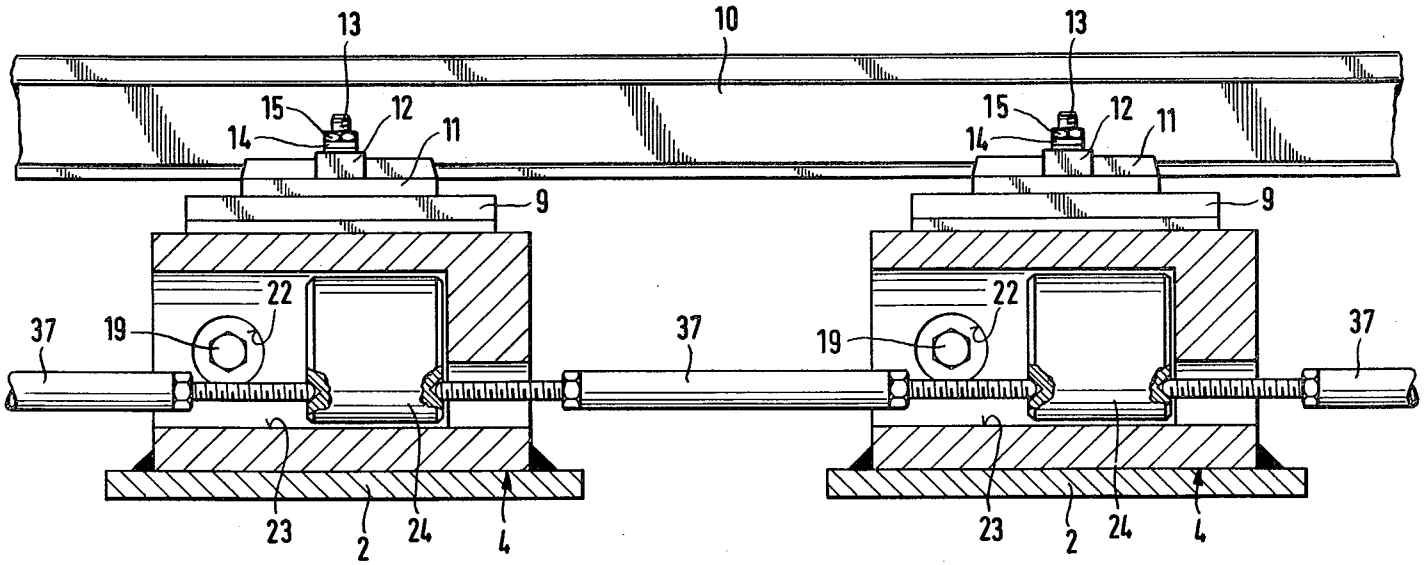
Figure 7:
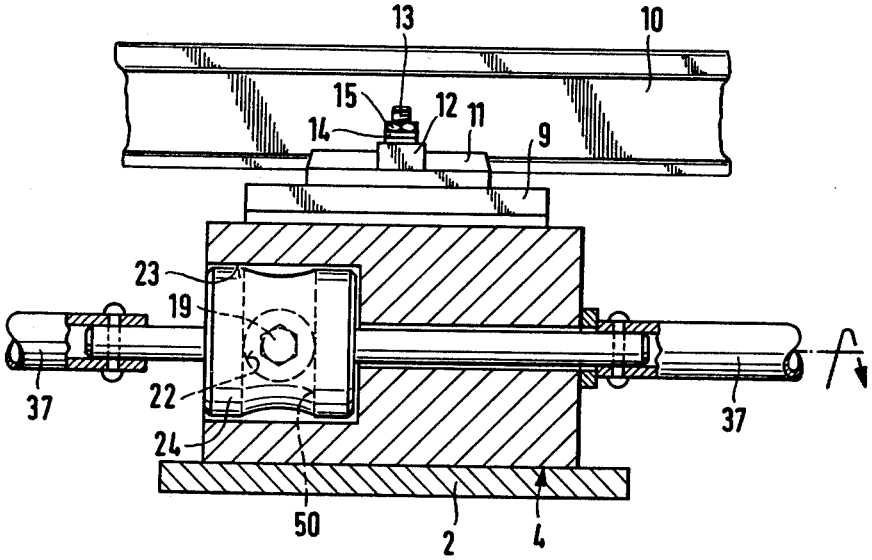
Figure 8:
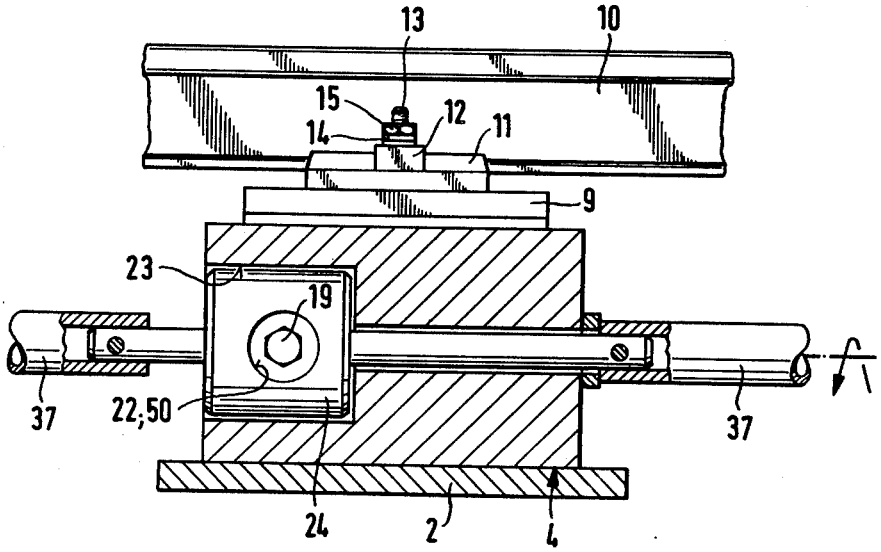

One embodiment according to the present invention will now be further described hereinafter and is illustrated in the accompanying drawings, wherein FIG. 1 is a side view of the slide chair sliding between the bearing blocks on the shaft, which slide chair will be identified hereinafter in short as a rail chair, FIG. 2 is a top plan view of this rail chair, wherein the outer bearing block is shown in cross-section, FIG. 3 and FIG. 4 illustrate the use of these rail chairs in the deflecting area of a switch, FIG. 5 is a cross-sectional view taken along line A–B of FIG. 3, FIG. 6 is a cross-sectional view taken along line C–D of FIG. 4, FIG. 7 is a segment of the cross-sectional view A–B of FIG. 3 (the thrust locking arrangement), and FIG. 8 is a segment of the cross-sectional view C–D of FIG. 4 (the rotary locking arrangement).

FIG. 1 illustrates the base plate 2 on which the bearing blocks 3 and 4 (the inner and outer blocks) are rigidly secured by welding. Set in the bores of the bearing blocks 3 and 4 is the shaft 5. The checking of the shaft 5 within the bearing blocks 3 and 4 is accomplished by means of the tight-fit screw 6. Slidingly positioned on the shaft 5 is the slide chair 9 composed of the bearing block 7 and the plate 8 secured thereto. The fastening of the rail 10 takes place by way of the ribbed plate 11 mounted on the slide chair 9, by way of the clamping plates 12, the bolt hooks 13, the lock washers 14, and the nuts 15. The connection between the parallel extending rails 10 is accomplished by the cross tie 16 which is hingedly secured to the plate 8 of the slide chair 9 by means of the king pins 17. The stopping of the rail 10 in the respectively required position thereof is effected by the threaded rods 18 and 19. The threaded rod 18 represents the precisely defined distance up to the elastic stop 21 mounted in the recess 20, and the threaded rod 19 in the recess 22 represents the precisely defined distance with respect to the locking element 24 which is positioned in the recess 23. The threaded rods 18 and 19 are checked with the hexagonal nuts 25 and the washers 26.

The shifting cylinder 27 serves for the horizontal transverse movement of the rail 10 which is secured to the slide chair 9. The housing 28 is force-lockingly connected with the bearing block 4 by way of the arm 29 and the bolts 30. The piston rod 31 which executes the transverse movement is connected with the slide chair 9 by way of the bearing 32 at the plate 8.

FIGS. 3 and 4 illustrate the so-called rail chairs 1 in the deflecting area of a switch in use. These rail chairs are positioned at a specific distance in this deflecting area. The parallel rails represent the straight or the branching-off track. In the running-in of the switch, the rails 10 are rigidly fastened with the ribbed plates 33 on the ground. The trunk or main track is formed by the pair of rails 34, and the branching-off track is formed by the pair of rails 35. The trunk or main and the branching-off track are rigidly connected with the ribbed plates 36 to the ground. The threaded rods 18 are so adjusted on the left-hand side that the threaded rods 19 resting against the locking elements 24 on the right-hand side are under a nominal press-on force. Established with the threaded rods 19 positioned on the right-hand side is the respective geometric position of the rail 10, whereas the threaded rods 18 positioned on the left-hand side assure the required press-on pressure by way of the elastic stops 21. The locking elements 24 are connected on both sides with each other and with the rod or linkage system 37. The reversal of the locking elements 24 is effected by the single-acting shifting cylinders 38, 39, 40, and 41.

The checking as to the correct position of the locking elements 24 is made by way of the limit switches 42, 43, 44, 45, 46, 47, 48, and 49. In the "straight" position (FIG. 3), the shifting cylinder 38 on the left-hand side has brought the locking elements 24 into the unlocked position thereof by way of the rod or linkage system 37. Hence the limit switches 42 and 44 are closed, whereas the limit switches 43 and 45 are open. The shifting cylinder 40 has brought the locking elements 24 on the right-hand side into the locked position thereof. Hence the limit switches 46 and 48 are closed, whereas the limit switches 47 and 49 are opened. By way of this combination of the limit switch positioning, the track-free signaling can be derived for the straight track.

The change-over procedure from the "straight" position, as illustrated in FIG. 3, into the branching-off position, as illustrated in FIG. 4, is effected in the following manner:

The shifting cylinders 27 as illustrated in FIG. 1 are set into operation, whereby the transversely movable positioned rails 10 are pushed toward the left, and specifically so that the elastic stops 21 positioned on the left-hand side are slightly over-pressed by the threaded rods 18, and so that the threaded rods 19 on the right-hand side will release the locking elements 24. After the locking elements 24 on the right-hand side have been released, the shifting cylinder 41 is put in operation, and the locking elements 24 are brought into the unlocked position thereof by way of the rod system 37. If the setting procedure has taken place correctly, the limit switches 47 and 49 must be closed, and the limit switches 46 and 48 must be open. This limit switch positioning triggers the polarity reversal of the direction of force at the shifting cylinder 27. The shifting cylinder 27 then pulls the rails 10 into the branching-off position for connection to the rails 35 of the branching-off track, and specifically to such an extent that now the elastic stops 21 are slightly over-pressed by the threaded rods 18 on the right-hand side. Therewith the path for the locking elements 24 on the left-hand side is free, and the shifting cylinder 39 can bring these locking elements 24 into the locked position thereof by way of the rod or linkage system 37. If the locking is flawless, the limit switching 43 and 45 must be closed, and the limit switches 42 and 44 must be open. In this limit switch position, the shifting cylinders 27 are placed out of operation, whereby the elastic stops 21 positioned on the right-hand side will press, with the elastic force thereof, the threaded rods 19 on the left-hand side against the locking elements 24. By way of the combination of the limit switch positioning illustrated in FIG. 4 (42, 44, 46, and 48 open; 43, 45, 47, and 49 closed), the track free-signaling for the branching-off track may be derived.

The position of the locking elements 24 and of the rod or linkage system 37 is apparent from FIGS. 5 an 6. In FIG. 5, the switch is in the position "straight ahead" and the locking elements 24 block the threaded rods 19 from the free passage through the bores 22 within the bearing blocks 4, i.e. the ends of the threaded rods 19 press against the locking element 24 being provided as a slide. The rod system 37 has pulled the slides into this position. In this position of the locking elements 24, the rail section for the straight-ahead position is locked and therewith blocked. In FIG. 6, the switch for the branching-off direction of travel has been set and blocked. In this position, the locking elements 24 being provided as slides release the path for the threaded rods 19 through the bores 22 in the bearing blocks 4. Once again the rod or linkage system 37 has pulled the slides into this position. The rod system 37 is positioned in the lower region of the bearing block 4. Therefore it does not hinder the free passage of the threaded rods 19 which find their passage above the rod system 37.

Illustrated in FIGS. 7 and 8 is another possibility for the locking and unlocking operation. The rod system 37 therein is axially rotatably provided. The locking element 24 has therein a bore 50 which has the same diameter as the bore 22 within the bearing block 4 and, in the unlocked condition thereof, renders possible the free passage of the threaded rod 19. In FIG. 7, the switch is in the locked condition thereof. The rod system 37 has been so axially rotated that the bore 50 is not in alignment with the bore 22, and the end of the threaded rod 19 presses against the thus closed locking element 24, thereby being retained. FIG. 8 illustrates the switch in the unlocked condition thereof. In this case the rod system 37 has been so axially rotated that the bore 50 of the locking element 24 is in alignment with the bore 22 of the bearing block 4 and so that the threaded rod 19 thus has free passage.

It will be obvious to those skilled in the art that many modifications may be made within the scope of the present invention without departing from the spirit thereof, and the invention includes all such modifications.

What is claimed is:

1. In a point switch in which the switch blades or tongues are composed of rail sections of the trunk or main track and are displaceably positioned on slide chairs in the transverse rail direction, the improvement comprising shaft means on which each slide chair is slidingly mounted between two bearing blocks, one of said bearing blocks being inside the track and the other of said bearing blocks being outside of the track, means rigidly connecting said bearing blocks with a joint base plate, and two rod means on each chair parallel to said shaft means, a first one of said rod means being adapted to contact a stop means in a recess in said outside bearing block, and a second one of said rod means being adapted to contact a locking means in a recess in said outside bearing block, whereby in an unlocked condition said first one of said rod means contacts said stop means, and in a locked condition said second one of said rod means contacts said locking means.

2. A point switch according to claim 1 in which each slide chair includes a block connected with a plate, said block having a first bore transversely positioned with respect to the longitudinal rail direction for the passage of said shaft means, and threaded bores on both sides of said first bore and parallel thereto for the attachment of said rod means.

3. A point switch according to claim 2 including means whereby said two rod means are adjustable within said block and are lockable in the adjusted position thereof.

4. A point switch according to claim 1 including hingedly-mounted cross tie means connecting oppositely-positioned slide chairs.

5. A point switch according to claim 1 including a joint rod means interconnecting said locking means of each of said sliding chairs, whereby all of said locking means on one side are lockable or unlockable in response to movement of said joint rod means, said joint rod means being guided in recesses of said outside bearing blocks, and said recesses being in the longitudinal rail direction.

6. A point switch according to claim 5 in which said joint rod means is a piston rod system means whereby the locking means within the bearing blocks are displaceable in the longitudinal rail direction.

7. A point switch according to claim 5 including means whereby said joint rod system means is axially rotatable and the locking means which are rigidly connected with the rod system means and have a cylindrical shape have, in the unlocked position, a bore into which said second one of said rod means is insertable.

8. A point switch according to claim 5 including hydraulic shifting cylinder means for effecting movement of said joint rod means.

* * * * *